US011006209B2

(12) United States Patent
Park et al.

(10) Patent No.: US 11,006,209 B2
(45) Date of Patent: May 11, 2021

(54) RECTANGULAR MICROSPEAKER

(71) Applicant: BUJEON CO., LTD., Ansan-si (KR)

(72) Inventors: Minkoo Park, Hwaseong-si (KR); Seungwoo Chun, Hwaseong-si (KR); Minkyeom Kim, Yangju-si (KR); Junho Yun, Ansan-si (KR); Halim Kim, Ansan-si (KR)

(73) Assignee: BUJEON CO., LTD., Ansan-si (KR)

( * ) Notice: Subject to any disclaimer, the term of this patent is extended or adjusted under 35 U.S.C. 154(b) by 0 days.

(21) Appl. No.: 16/689,200

(22) Filed: Nov. 20, 2019

(65) Prior Publication Data

US 2021/0044893 A1 Feb. 11, 2021

(30) Foreign Application Priority Data

Aug. 7, 2019 (KR) ..... 10-2019-0096290

(51) Int. Cl.
*H04R 1/28* (2006.01)
*H04R 9/00* (2006.01)

(52) U.S. Cl.
CPC ..... *H04R 1/2834* (2013.01); *H04R 2400/11* (2013.01)

(58) Field of Classification Search
CPC ..... H04R 1/28; H04R 1/2807; H04R 9/00
USPC ..... 381/337–339, 396
See application file for complete search history.

(56) References Cited

U.S. PATENT DOCUMENTS 5,790,679 A * 8/1998 Hawker ..... H04M 1/0202 379/388.02
7,382,048 B2 * 6/2008 Minervini ..... H04R 1/028 257/723

FOREIGN PATENT DOCUMENTS

KR 10-2003-0032446 A 4/2003
KR 10-2018-0042757 A 4/2018
KR 10-1913154 B1 11/2018
KR 10-1958257 B1 7/2019

* cited by examiner

*Primary Examiner* — Suhan Ni
(74) *Attorney, Agent, or Firm* — KORUS Patent, LLC; Seong Il Jeong

(57) ABSTRACT

A rectangular microspeaker according to the present invention transfers vibration sound through the front surface or side surface of a diaphragm. In order to maximize an effective vibration area and to expand a volume, all parts including a frame are fabricated in a rectangular shape. The present invention is applied to a P type, an F type, and a composite type. The vibration sound generated on the bottom of the diaphragm as well as the vibration sound generated on the top of the diaphragm may be discharged through the side surface. A magnetic field part may be insert-molded separately or along with the frame.

16 Claims, 18 Drawing Sheets

RECTANGULAR MICROSPEAKER

CROSS-REFERENCE TO RELATED APPLICATION

This application claims the benefit of Korean Patent Application No. 10-2019-0096290 filed on Aug. 13, 2019, which is hereby incorporated by reference herein in its entirety.

BACKGROUND

1. Technical Field

The present invention relates to a rectangular microspeaker. More specifically, the present invention relates to a rectangular microspeaker which can implement the maximization of an effective area through a rectangular design in order to overcome the limited effective vibration area of a circular microspeaker.

2. Description of the Related Art

Generally, microspeakers, such as earphones, are widely used for converting electrical signals into acoustic signals in portable electronic devices, such as smartphones, portable communication terminals, notebook computers, MP3 players, etc.

As shown in FIG. 1, such a type of microspeaker includes: a driver which includes a diaphragm 6', a plate 8', a magnet 10', and a yoke 12'; a frame 4' which accommodates the driver therein; and a housing 2' which accommodates the frame 4' and on the entrance of which is mounted an ear cap configured to enable insertion into the ear. The cross section of the housing 2' is circular to facilitate insertion into the ear. Accordingly, each part of a driver module and the frame 4' are also formed to be circular. Although the circular microspeaker is advantageous for a reduction in the size of products, it has the disadvantage of a small effective vibration area.

Unlike the earphone of FIG. 1, some of the microspeakers which are mounted on electronic parts adopt a flat structure including rectangular parts and a rectangular frame. However, a sound discharge path extends in a forward direction (the left direction of FIG. 1) as in the microspeaker of FIG. 1, and this direction is the same as the direction in which a diaphragm vibrates. However, a sound discharge path does not necessarily have to coincide with the direction of vibration. In addition, a product in which a rectangular microspeaker is applied to an earphone has not been commercialized yet.

The inventors of the present invention have developed a microspeaker having a completely new structure which discharges vibration sound to a side rather than a top with respect to a diaphragm, unlike the conventional microspeakers. Furthermore, in order to secure the performance of this microspeaker, it has been recognized that a rectangular microspeaker is an optimal design to maximize an effective vibration area.

The present invention was completed based on the above-described knowledge.

SUMMARY

An object of the present invention is to provide a rectangular microspeaker which can implement the maximization of an effective area through a rectangular design in order to overcome the limited effective vibration area of a circular microspeaker.

In order to accomplish the above object, the present invention provides a rectangular microspeaker including: a plate configured to constitute a part of a magnetic field part, a magnet configured to be disposed beneath the plate, a diaphragm configured to be disposed on the plate, and a frame configured to accommodate the diaphragm, the plate, and the magnet; wherein the path of vibration sound generated by the diaphragm is formed to be perpendicular to a direction in which the diaphragm vibrates so that the vibration sound is discharged through a side surface of the diaphragm or the path of vibration sound generated by the diaphragm is formed to be identical to a direction in which the diaphragm vibrates so that the vibration sound is discharged through a front surface of the diaphragm.

A grille may be disposed over the diaphragm, and a sound discharge opening configured to discharge vibration sound may be formed in one side surface of the grille.

A sound discharge opening configured to discharge vibration sound may be formed in one side surface of the frame.

A printed circuit board (PCB) may be mounted on an opposite side surface of the grille or frame.

Each of the diaphragm, the plate, and the magnet may have a rectangular appearance, having long opposite rectilinear upper and lower sides in accordance with a shape of the frame, as a whole.

Additional spaces may be secured in such a manner that outer portions of the plate are cut away in the corner portions of the frame and a rectangular magnet, the corner portions of which are chamfered or rounded, is disposed.

The sound discharge opening may be formed at a location below the diaphragm so that vibration sound generated on the bottom surface of the diaphragm is discharged through the side surface of the diaphragm.

The rectangular microspeaker may be of an F-type in which the yoke is disposed outside the magnet.

The rectangular microspeaker may be of a P-type in which the yoke is disposed inside the magnet.

The plate, the magnet, and the yoke may be insert-molded.

The plate, the magnet, and the yoke may be insert-molded along with the frame.

The griller may be integrated with the frame so that the frame also functions as the grille.

The magnet may include magnets which are arranged on at least both sides of the frame along a major or minor axis of the frame.

The magnet may further include a magnet which is placed on a center portion of the frame.

The present invention provides an acoustic device comprising the microspeaker.

The acoustic device may further include a housing configured to accommodate the microspeaker.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION

A rectangular microspeaker 1 according to the present invention will be described in detail with reference to the accompanying drawings. Each embodiment according to the present invention is merely one example intended to help the understanding of the present invention, and the present invention is not limited to such an embodiment. The present invention may include the combination of any one or more of individual components and functions included in each embodiment.

Figure 1:
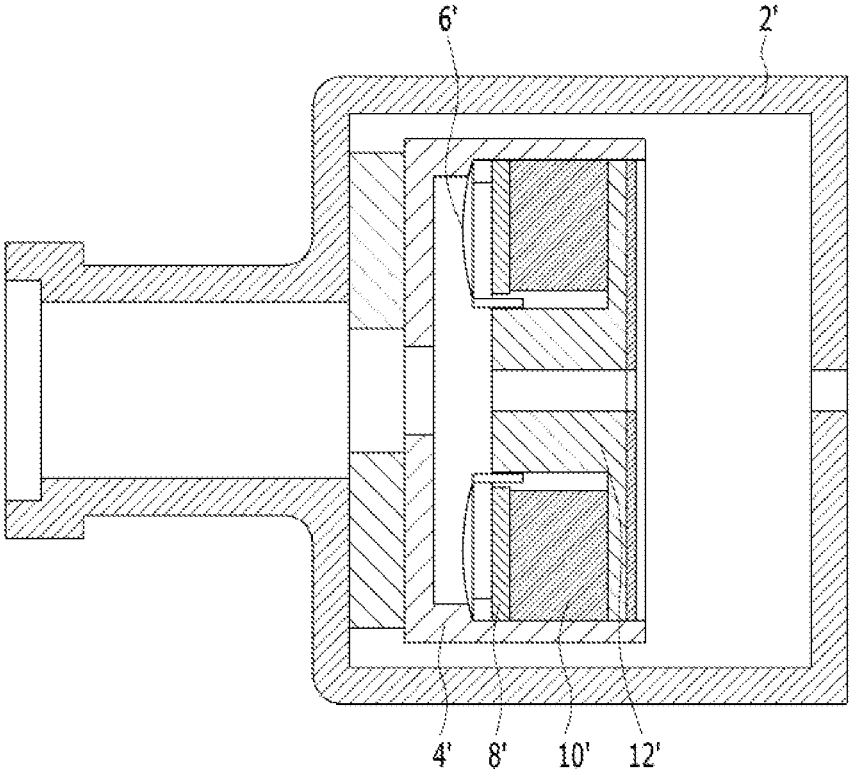
Prior Art FIG. 1
FIG. 1 is a sectional view of a conventional earphone.
Figure 2A:
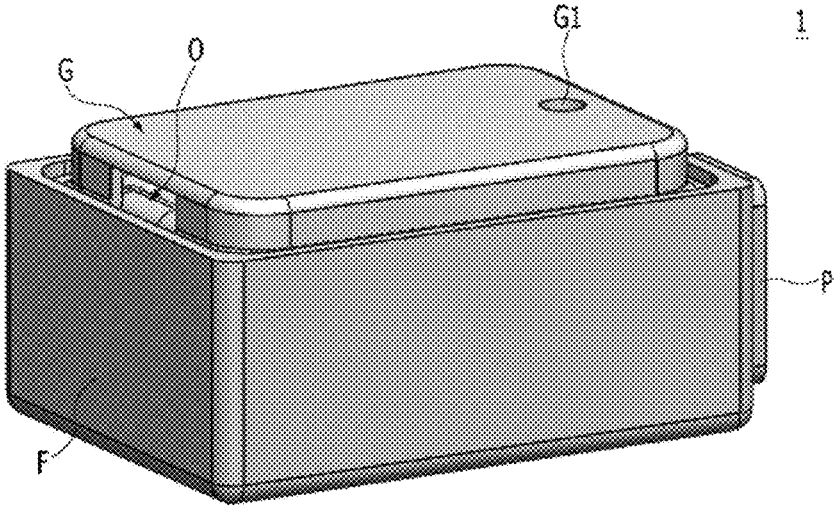
FIG. 2A is an external perspective view of a microspeaker according to an embodiment of the present invention.
Figure 2B:
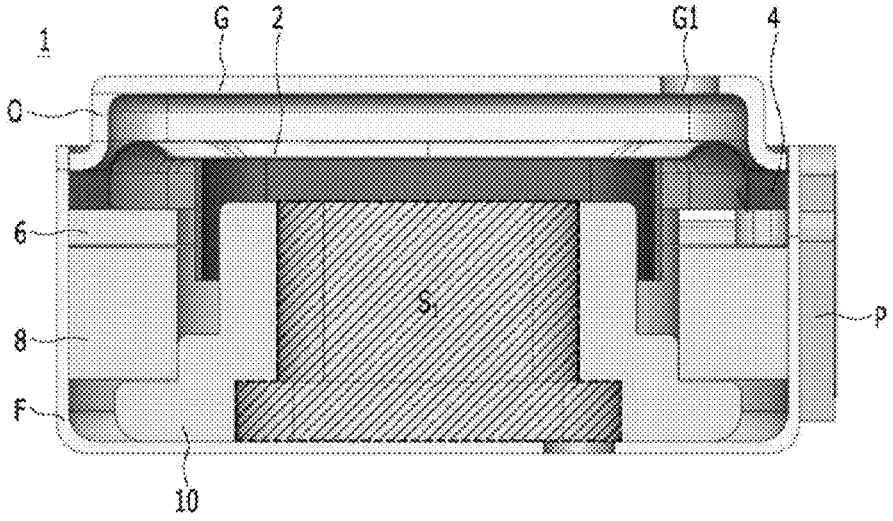
FIG. 2B is a sectional view of the microspeaker of FIG. 2A taken along the longitudinal centerline of the microspeaker.
Figure 2C:
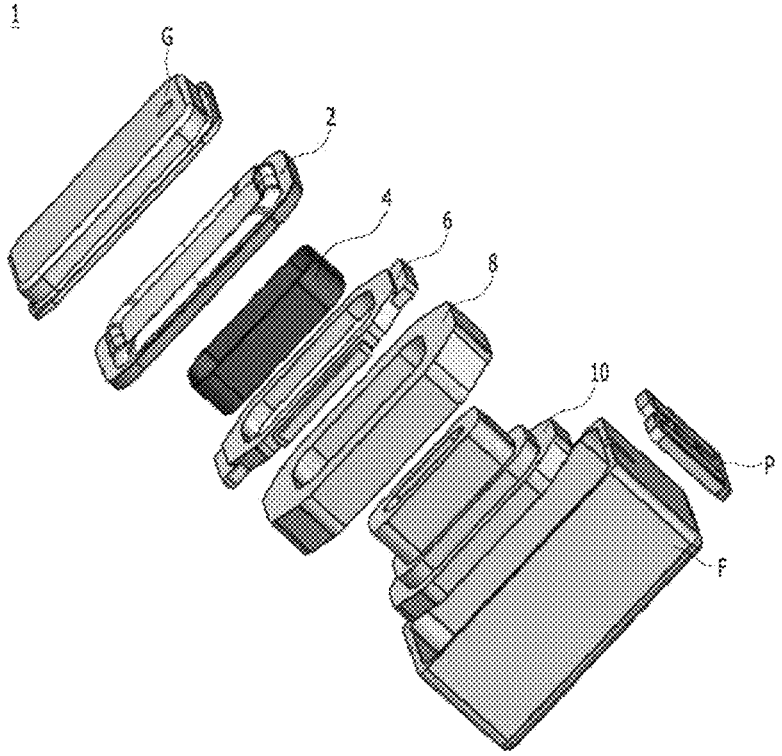
FIG. 2C is an exploded perspective view of the microspeaker of FIG. 2A.

FIG. 2A is an external perspective view of a microspeaker 1 according to the present invention, FIG. 2B is a sectional view taken along a longitudinal centerline, and FIG. 2C is an assembly view of all parts.

Referring to these drawings together, the microspeaker 1 includes: a diaphragm 2; a support ring 4 which is disposed along the edges of the bottom of the diaphragm 2; and a plate 6 and a magnet 8 which are disposed below the support ring 4. A yoke 10 is disposed in a space between the plate 6 and the magnet 8. The lower portion of the yoke 10 protrudes below the magnet 8, and thus provides a wide space S1, as shown in FIG. 2B. A grille G is disposed above the diaphragm 2, and a frame F is joined to the edges of the grille G and accommodates speaker parts below the diaphragm 2. A voice coil C is disposed along a boundary between the center dome and edge dome of the bottom surface of the diaphragm 2. A PCB P electrically connected to the voice coil C is disposed at a location covering a side surface of the frame F, e.g., the right surface of the frame F, other than the bottom of the yoke 10, unlike in the conventional technology.

Although an F-type speaker in which the magnet 8 is disposed outside the yoke 10 has been described in the illustrated example, the present invention is applied to both a P-type speaker in which a magnet 8 is disposed inside the yoke 10 and a composite-type speaker.

FIG. 2B desirably shows the features of the microspeaker of the present invention. The external shape of the microspeaker 1 is formed as a rectangle as a whole. Accordingly, the grille G has a top surface having a rectangular shape. The edges of the grille G are bent downward. The frame F provides a rectangular space, and the upper edges of the frame F are bonded to the ends of the bent portions of the grille G. Alternatively, the edges of the bent portions of the grille G may abut on the frame F, e.g., in a curling manner. A long rectangular slot is formed in a side of the grille G, e.g., the left side of the grille G, at the center of one of the bent portions. This is a sound discharge open O through which the sound of the diaphragm 2 is emitted. A hole G1 formed in the top of the grille G at a distant location facing the sound discharge opening O is intended to balance air pressure by releasing high-pressure external air acting on the ear canal.

In the present invention, the vibration generated by the diaphragm 2 is discharged to the outside through the sound discharge opening O opened through the side. In other words, the vibration direction of the diaphragm 2 itself and the traveling direction of an effective sound wave are perpendicular to each other. Although the sound discharge opening O may be made as a rectangle or oval slot, it may be variously modified to ensure excellent sound quality.

The sound discharge opening O may be formed in the frame F, other than the grille G. Furthermore, the sound discharge opening O may transfer the vibration sound of the top surface of the diaphragm 2, but may also emit the vibration sound of the bottom surface of the diaphragm 2 through the side surface.

According to the present invention, it can be understood that the parts accommodated in the grille G and the frame F do not need to be fabricated in a circular shape as before. As shown in FIG. 2C, the diaphragm 2, the support ring 4, the plate 6, the magnet 8, and the yoke 10 each have long opposite rectilinear upper and lower sides in accordance with the shape of the frame F, and both short sides are each formed by combining a straight line and an inclined or rounded portion, thereby showing a rectangular appearance as a whole.

The advantages of the present invention having the configuration of the rectangular microspeaker 1 will be described with reference to FIGS. 3A to 3C and FIG. 16.

Figure 3A:
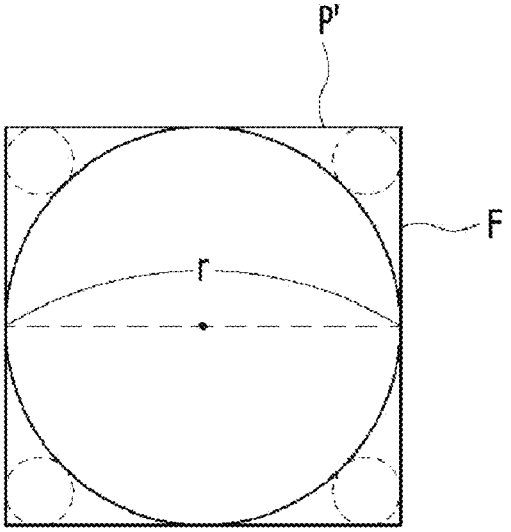
FIG. 3A is a view showing a circle and a square surrounding the circle.

In general, when the area of a circle having a diameter r and the area of a square having each side length r are compared with each other, as shown in FIG. 3A, the latter has an about 30% larger area, thereby increasing a mounting area for parts. According to the present invention, the microspeaker 1 is fabricated in a rectangular shape having two longer sides, the rectangular shape can theoretically ensure a wider mounting area than a square shape.

Figure 16:
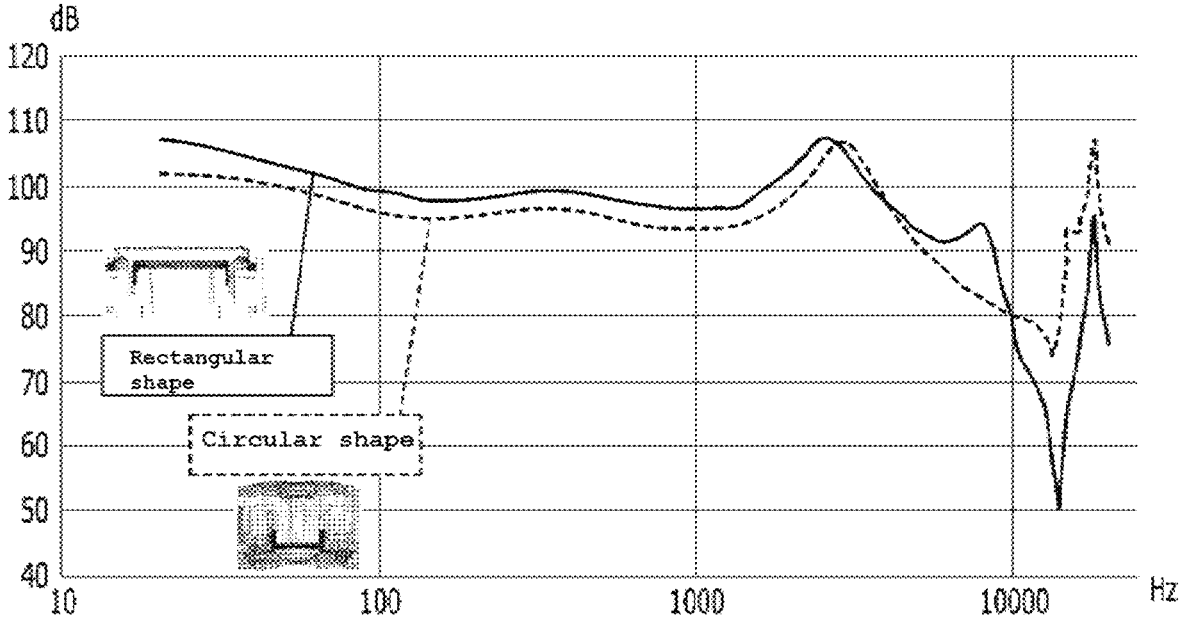
FIG. 16 is a frequency-sound pressure graph comparing a rectangular microspeaker and a circular microspeaker.

According to the experimental results of the inventors, as a result of comparing a circular microspeaker having a diameter of 6 mm and the rectangular microspeaker 1 having the same volume as the former microspeaker, the effective vibration area of the diaphragm 2 was increased by about 29%. Furthermore, as shown in FIG. 16, the sound pressure increased by 3 dB or more could be obtained at 10 kHz or lower, which is a main audible band.

The circular microspeaker can increase an internal volume by reducing the size of a magnetic field part composed of the yoke, the magnet and the plate, but the loss of magnetic flux density is large. In contrast, the rectangular microspeaker 1 may maximize an internal space volume while maintaining a stable magnetic flux density.

More specifically, as shown in FIG. 2B, a lower space protruding outward from a space provided by the yoke 10 below the magnet 8 may be additionally secured.

Figure 3B:
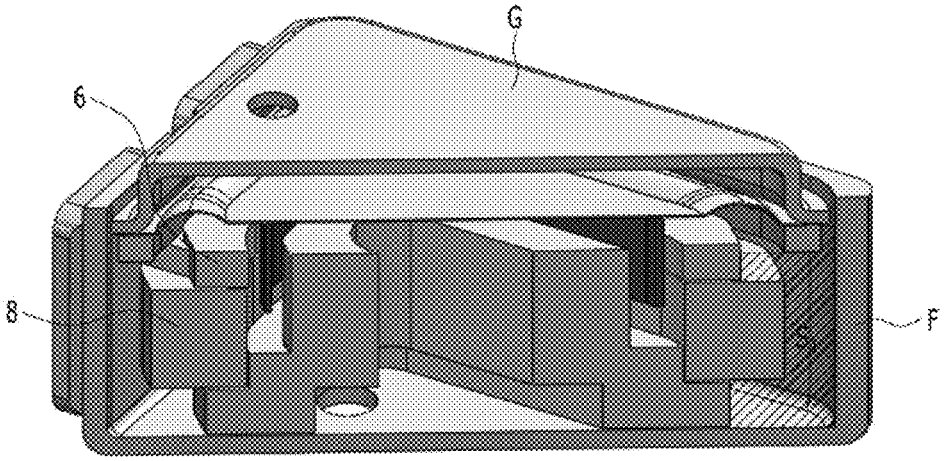
FIG. 3B is a diagonal sectional view showing a state in which additional spaces constituting a conduit are secured in the corner portions of the rectangular spaces of a microspeaker.

Furthermore, as shown in FIG. 3B, additional spaces S2 constituting a conduit may be secured in four corner portions (see the dotted line region in FIG. 3A) of the rectangular space. The microspeaker 1 of FIG. 3B is shown as a microspeaker in which the additional spaces S2 are secured by cutting away the outer portions of the plate 6 at respective corners and disposing the rectangular magnet 8 having inclined surfaces with the corner portions chamfered or rounded, as shown in FIG. 2C.

Figure 3C:
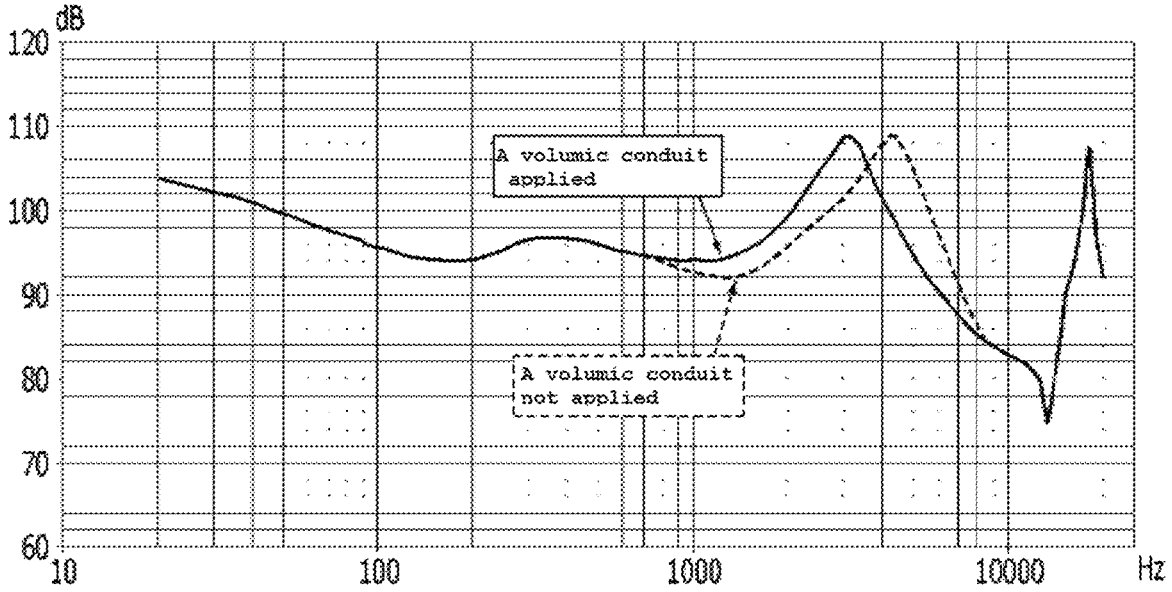
FIG. 3C is a frequency-sound pressure graph comparing a case where additional spaces are secured with a case where additional spaces are not secured.

FIG. 3C is a frequency-sound pressure graph comparing a case where the additional spaces S2 are secured with a case where the additional spaces S2 are not secured. It can be seen that if a volumic conduit is added, the sound pressure is high in the frequency range of 1 to 5 kHz. Otherwise, the sound pressure is high at the frequency range of 5 to 10 kHz. Therefore, the location of an acoustic resonance part may be controlled by appropriately changing the volume or installation location of the volumic conduit.

According to the present invention, by adopting the rectangular microspeaker 1, there can be achieved the advantages of increasing an effective vibration area and expanding an internal space without loss of magnetic flux density.

Moreover, when the advantages of the rectangular microspeaker 1 are utilized, it is also possible to dispose the sound discharge opening in the front surface of a frame in a direction identical to the vibration direction of the diaphragm.

Various modifications may be made to the present invention within the scope of the above-described technical spirit. Another embodiment of the present invention will be described with reference to the drawings below. Descriptions of members which are the same as those of the above-described embodiment will be omitted, and a description will be given with a focus on the differences. In the following description, an embodiment in which a sound discharge opening is disposed in a side of a diaphragm will be described.

Figure 4A:
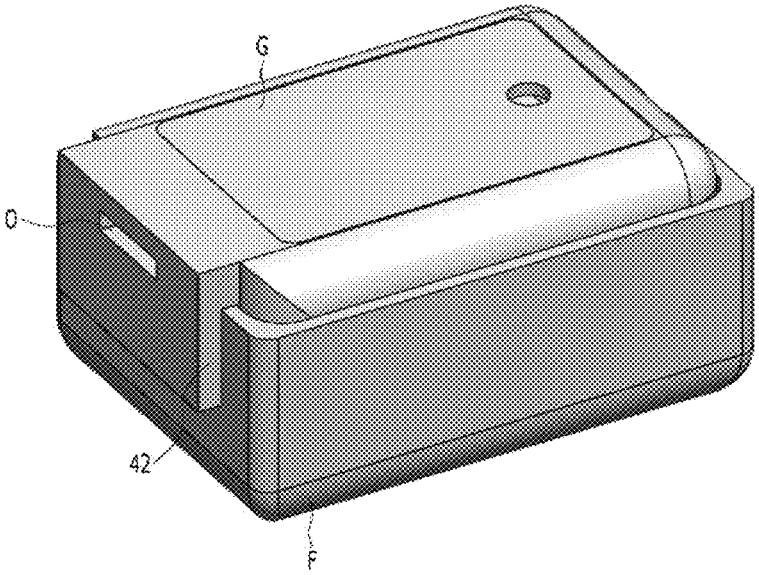
FIG. 4A is an external perspective view of a microspeaker according to another embodiment of the present invention.
Figure 4B:
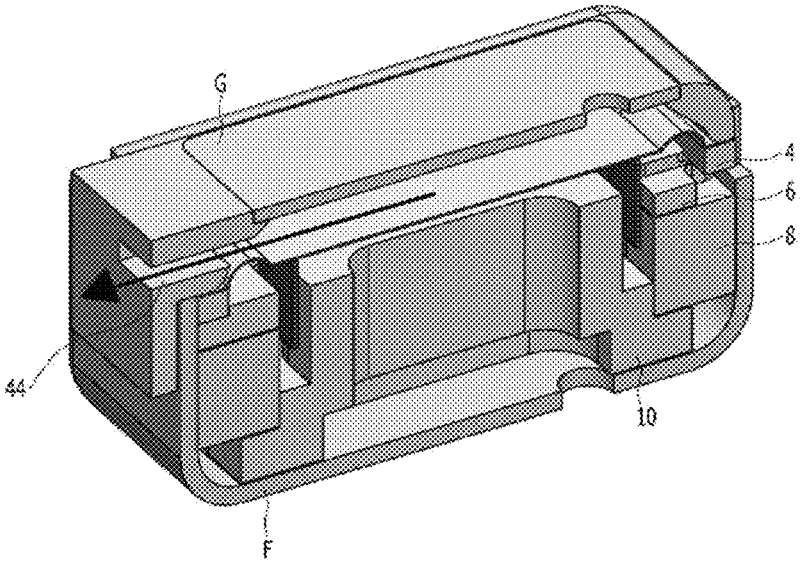
FIG. 4B is a sectional view of the microspeaker of FIG. 4A taken along the longitudinal centerline of the microspeaker.

In the microspeaker 1 of FIGS. 4A and 4B, the left part 42 of a grille G protrudes beyond the boundary of a frame F, and a side wall is extended downward so that a sound discharge opening O may be directly formed in the left part 42. The grille G provides a unique sound discharge guide 44. The grille G having the above-described shape is preferably made of a resin material having desirable workability. The arrow indicates a sound discharge path.

Figure 5A:
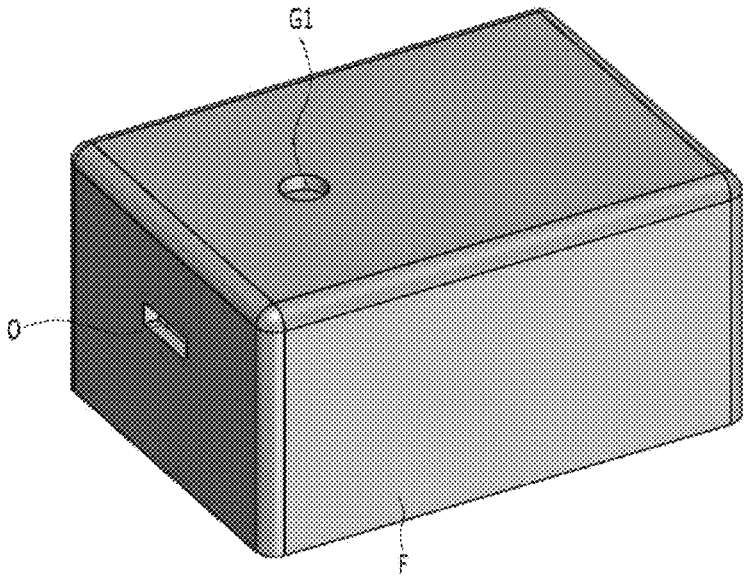
FIG. 5A is an external perspective view of a microspeaker according to another embodiment of the present invention.
Figure 5B:
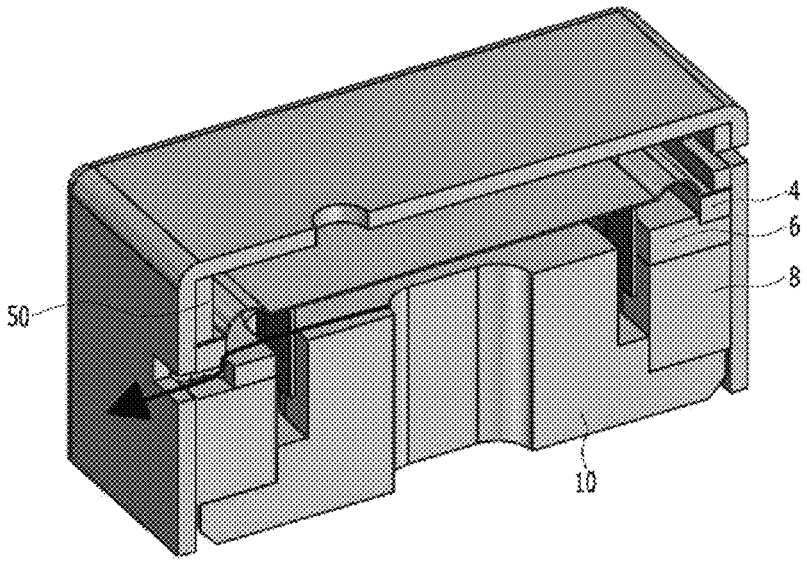
FIG. 5B is a sectional view of the microspeaker of FIG. 5A taken along the longitudinal centerline of the microspeaker.

In the microspeaker 1 of FIGS. 5A and 5B, a single frame F constitutes an overall appearance, and an upper support ring 50 is installed to support a diaphragm 2 instead of a grille G in an upper portion. A sound discharge opening O is formed in a left side of the frame F, and a hole G1 is formed in the top of the frame F such that the top of the frame F also function as the grille G. The frame F is preferably made of a stainless steel material, and may be molded simply by pressing.

Figure 6A:
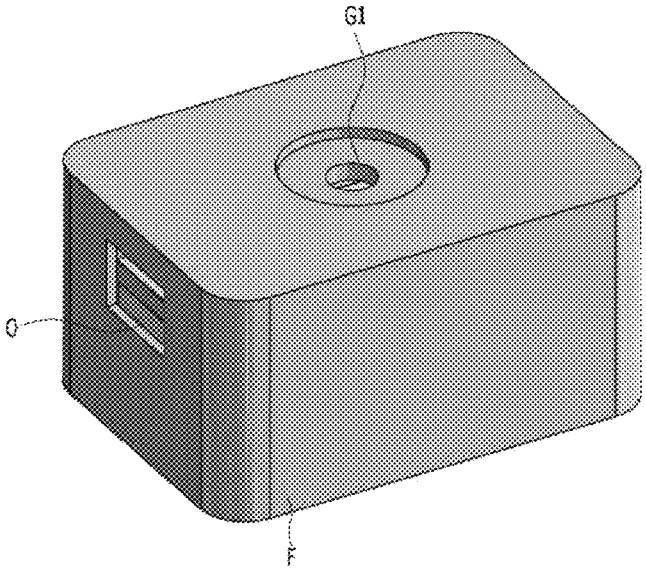
FIG. 6A is an external perspective view of a microspeaker according to another embodiment of the present invention.
Figure 6B:
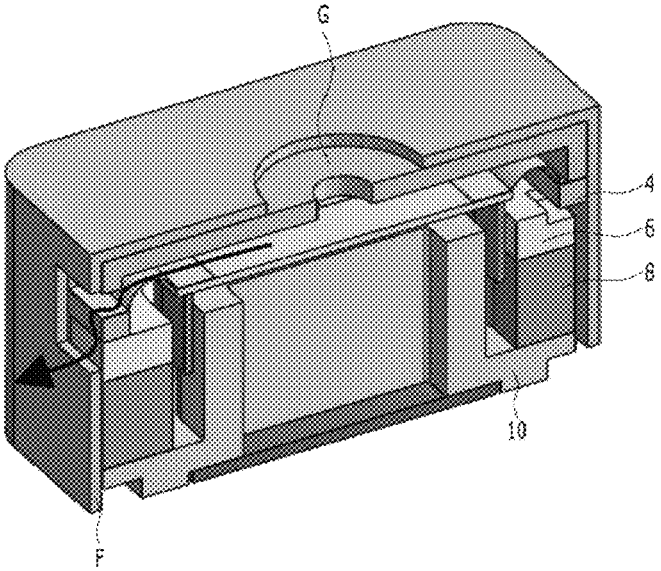
FIG. 6B is a sectional view of the microspeaker of FIG. 6A taken along the longitudinal centerline of the microspeaker.

In the microspeaker 1 of FIGS. 6A and 6B, a frame F is fabricated in a hexahedral shape in which a bottom is opened and top and side surfaces are closed, and accommodates a grille G therein. A sound discharge opening O is formed to be large, and thus sound is also discharged through the gap between a support ring 4, a plate 6 and/or the frame F. Since the sound discharge opening O is large, a hole G1 is formed at the center of the top surface of the frame F in order to effective release high pressure.

Figure 7A:
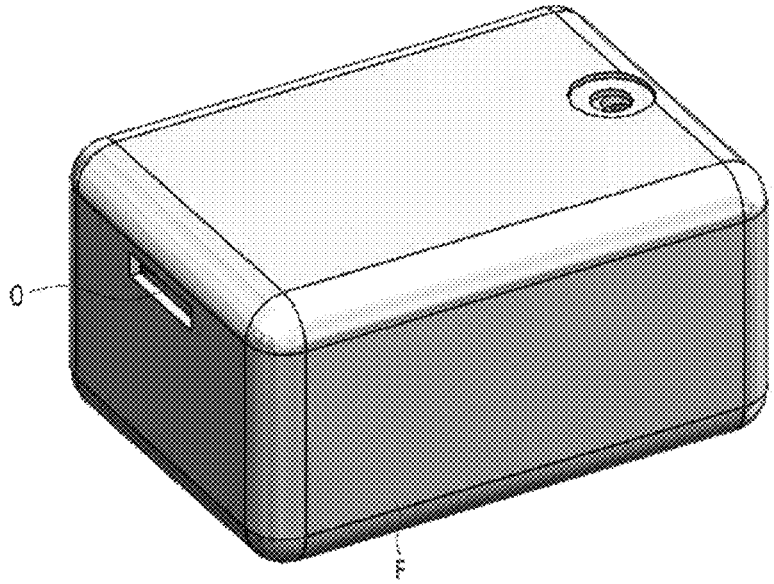
FIG. 7A is an external perspective view of a microspeaker according to another embodiment of the present invention.
Figure 7B:
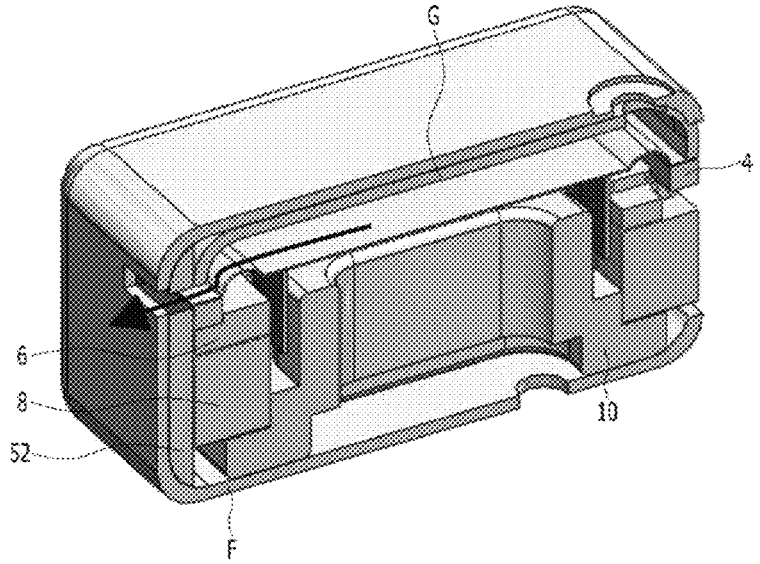
FIG. 7B is a sectional view of the microspeaker of FIG. 7A taken along the longitudinal centerline of the microspeaker.

In the microspeaker 1 of FIGS. 7A and 7B, a frame F is fabricated in a hexahedral shape in which all the sides thereof, except for a side thereof on which a PCB P is to be installed, are closed, and accommodates a grille G therein. A sound discharge opening O is smaller in size than that shown in FIG. 6, and a sound discharge path is formed at the same height as an edge dome on the top surface of the support ring 6. The gap between the inner surface of the frame F and a magnet 8 is filled with a reinforcing plate 52.

Figure 8A:
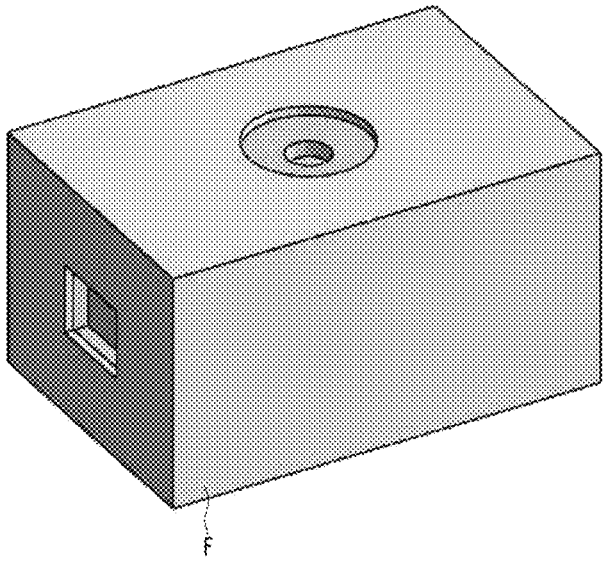
FIG. 8A is an external perspective view of a microspeaker according to another embodiment of the present invention.
Figure 8B:
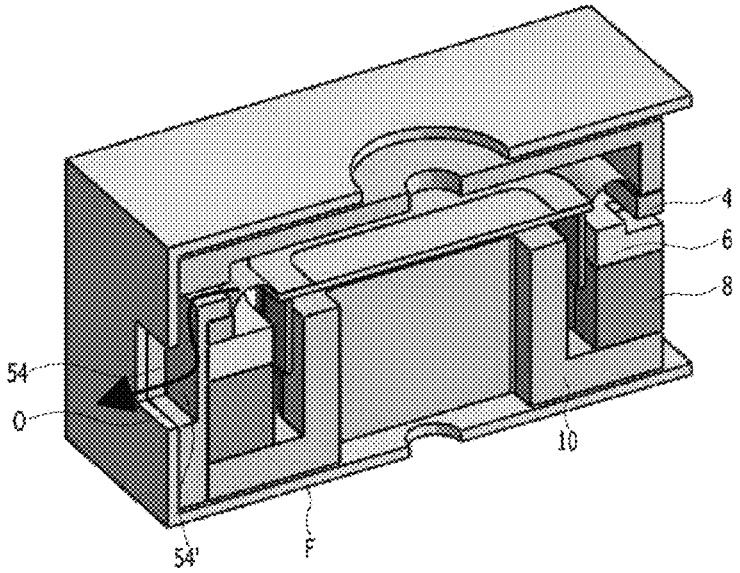
FIG. 8B is a sectional view of the microspeaker of FIG. 8A taken along the longitudinal centerline of the microspeaker.

In the microspeaker 1 of FIGS. 8A and 8B, a frame F is fabricated in a hexahedral shape in which all the sides thereof, except for a side thereof on which the PCB P is to be installed, are closed, and accommodates the grille G therein. A sound discharge opening O is formed at the center part of a side surface of the frame F. The side surface 54 of the grille G extends to the bottom surface of the frame F, and a cutout portion 54' is formed in the side surface 54 so that vibration sound passes through the cutout portion 54' and is discharged through the center portion of the frame F.

Next, the following embodiments disclose modified examples in which the assembly method or a sound discharge path is different from the above-described embodiments.

<Embodiment in which a Magnetic Field Part is Insert-Molded>

Figure 9A:
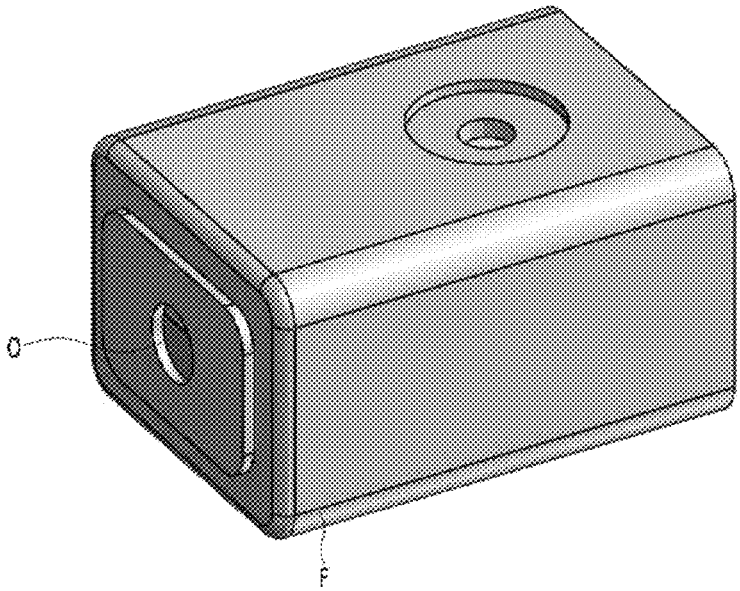
FIG. 9A is an external perspective view of a microspeaker according to another embodiment of the present invention.
Figure 9B:
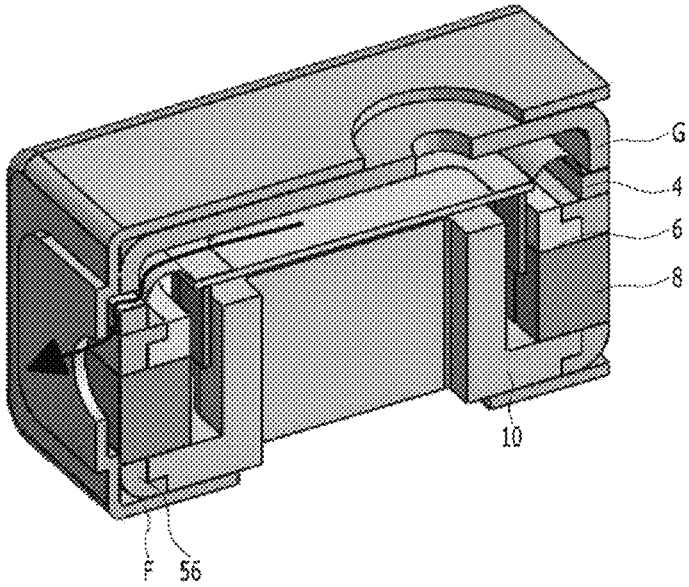
FIG. 9B is a sectional view of the microspeaker of FIG. 9A taken along the longitudinal centerline of the microspeaker.

In the microspeaker 1 of FIGS. 9A and 9B, a frame F is fabricated in a hexahedral shape in which all the sides thereof, except for a side thereof on which a PCB P is to be installed and the center of the bottom surface of a yoke 10, are closed, and accommodates a grille G therein. A sound discharge opening O is formed in the center portion of a side of the frame F. A sound discharge path is formed such that vibration sound passes through the top of a diaphragm 2 and proceeds to the sound discharge opening O along the gap between the frame F, a support ring 4 and/or a plate 6. The plate 6, the magnet 8 and the yoke 10 constituting the magnetic field part are preferably insert-molded in an integrated manner. For this purpose, a step is formed on the plate 6, and a reinforcing frame 56 is disposed between the outer surface of the bottom of the yoke 10 and the step so that the magnetic field part is molded in an integrated manner without a gap. When the magnetic field part is designed in an insert structure, sealing is made easy and assembly is simplified.

<Embodiment in which Vibration Sound is Transferred Below a Diaphragm and a Magnetic Field Part and a Frame are Insert-Molded>

Figure 10A:
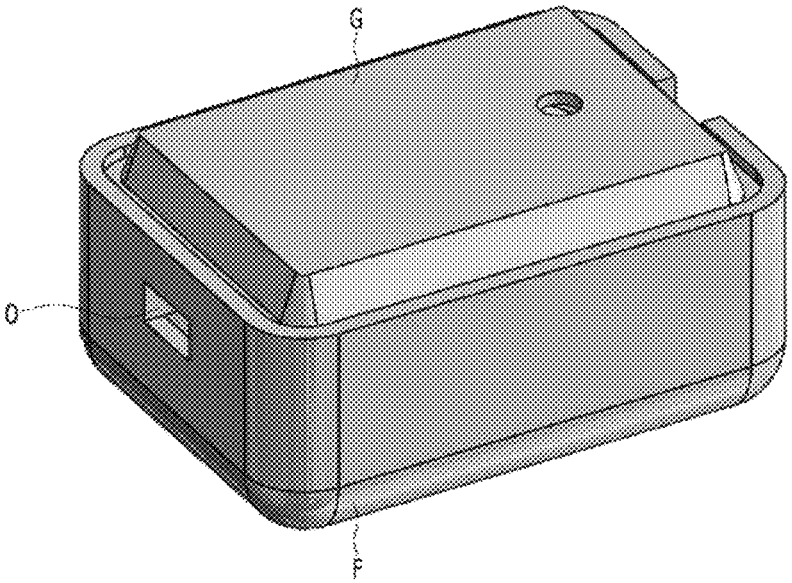
FIG. 10A is an external perspective view of a microspeaker according to another embodiment of the present invention.
Figure 10B:
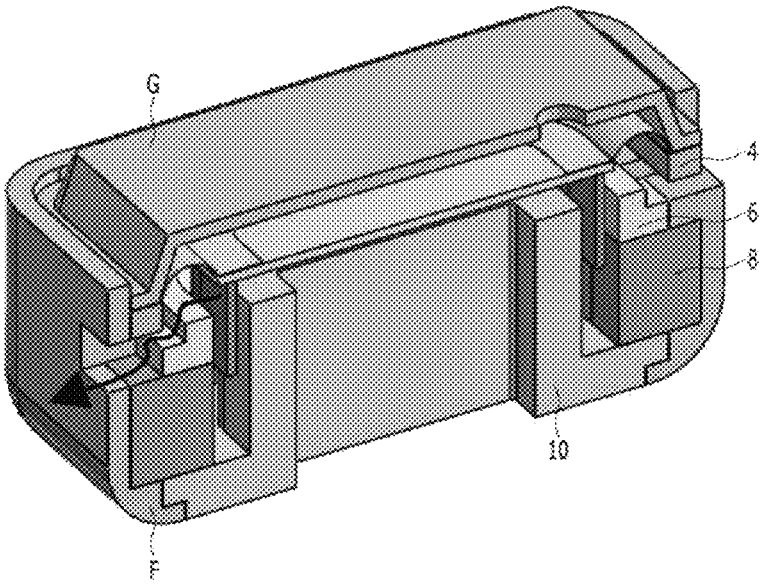
FIG. 10B is a sectional view of the microspeaker of FIG. 10A taken along the longitudinal centerline of the microspeaker.

The microspeaker 1 of FIGS. 10A and 10B discharges the vibration sound, generated on the bottom of a diaphragm 2, through a sound discharge opening O, formed in a side of a frame F, via a space between a plate 6 having a step, the bottom of a support ring 4, and/or the top of a magnet 8 without using the vibration sound of the top surface of the diaphragm 2. In order to prevent the sound generated on the bottom of the diaphragm 2 from leaking to the outside, a magnetic field part (including the plate 6, the magnet 8, and a yoke 10) and the frame F are preferably insert-molded in an integrated manner. Since the bottom surfaces of the frame F and the yoke 10 are hermetically joined to each other by insert molding, as shown in the drawings, vibration sound does not leak through the bottom of the microspeaker 1. The frame F is preferably made of resin. The edges of a grille G are curled to the inner surface of the frame F while the grille G is covering the open top. The edges of the grille G are hermetically jointed to the outer circumference of the diaphragm 2, and prevent the vibration sound generated on the top of the diaphragm 2 from being transmitted to the sound discharge opening O.

Figure 11A:
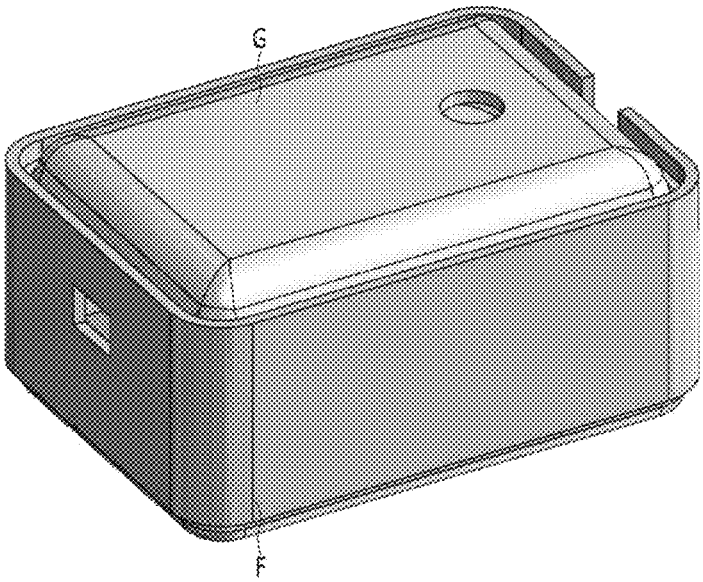
FIG. 11A is an external perspective view of a microspeaker according to another embodiment of the present invention.
Figure 11B:
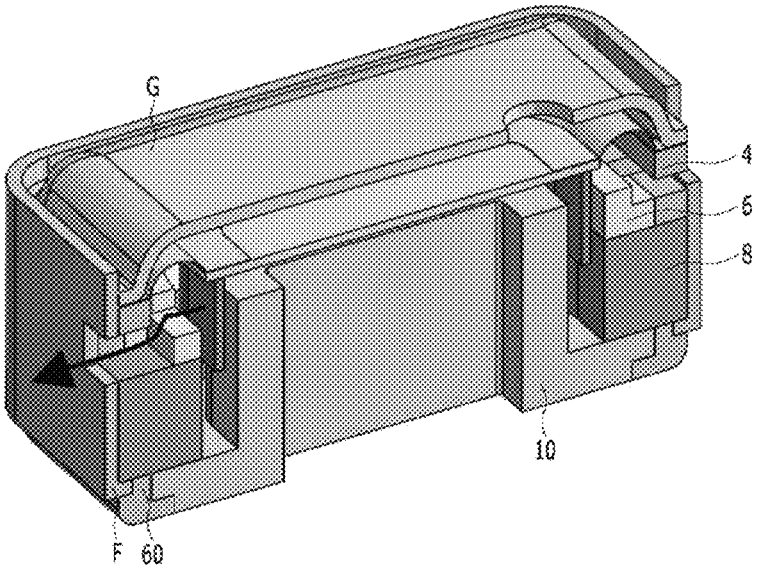
FIG. 11B is a sectional view of the microspeaker of FIG. 11A taken along the longitudinal centerline of the microspeaker.

The microspeaker 1 of FIGS. 11A and 11B basically has the same structure as that of FIG. 10, and a magnetic field part and a frame F are insert-molded. However, for example, when the frame F is made of a stainless steel material, an intermediate frame 60 having a shape similar to that of FIG. 9 is interposed between and seals the frame F and the outer surface of the bottom of a yoke 10 without bending the lower portion of the frame F inward in order to be hermetically joined to the yoke 10. Although the intermediate frame 60 has a shape similar to that of the reinforcing frame 56, they differ in that the intermediate frame 60 is a member used to mold the magnetic field part and the frame F in an integrated manner.

<Embodiment in which a Magnetic Field Part and a Frame are Insert-Molded>

Figure 12A:
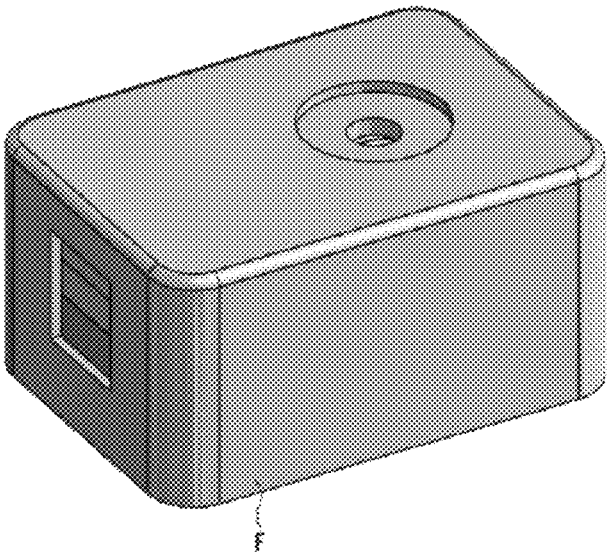
FIG. 12A is an external perspective view of a microspeaker according to another embodiment of the present invention.
Figure 12B:
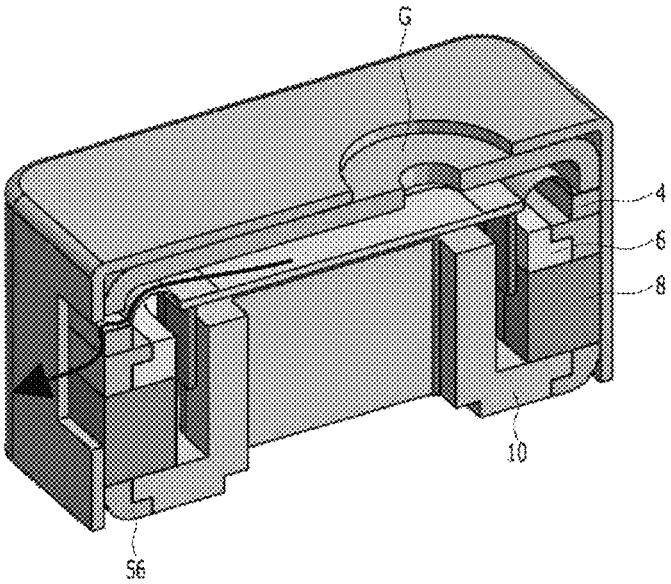
FIG. 12B is a sectional view of the microspeaker of FIG. 12A taken along the longitudinal centerline of the microspeaker.

The microspeaker 1 of FIGS. 12A and 12B is the same as that of FIG. 9, and a plate 6, a magnet 8 and a yoke 10 constituting a magnetic field part are insert-molded in an integrated manner. However, the lower part of the frame F is not bent inward, but is completely open.

<Example in which Vibration Sound is Transmitted Below a Diaphragm and a Magnetic Field Part is Insert-Molded>

Figure 13A:
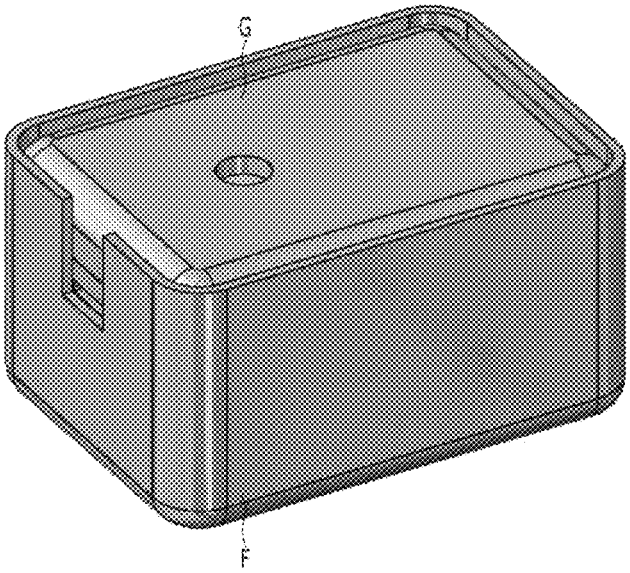
FIG. 13A is an external perspective view of a microspeaker according to another embodiment of the present invention.
Figure 13B:
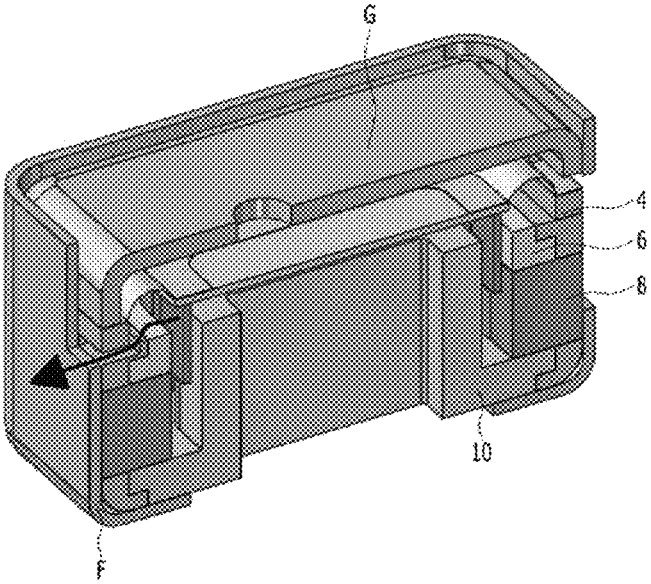
FIG. 13B is a sectional view of the microspeaker of FIG. 13A taken along the longitudinal centerline of the microspeaker.

Although the microspeaker 1 of FIGS. 13A and 13B is basically similar to that of FIG. 10, only a magnetic field part is insert-molded, and the lower portion of a frame F is bent inward and supports a reinforcing frame 56 and a yoke 10.

<Microspeakers which have Various Magnet Arrangements>

Figure 14A:
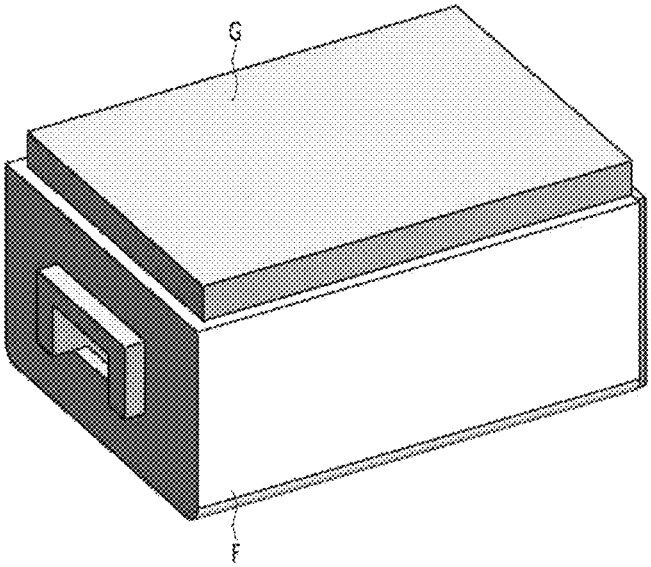
FIG. 14A is an external perspective view of a microspeaker according to another embodiment of the present invention.
Figure 14B:
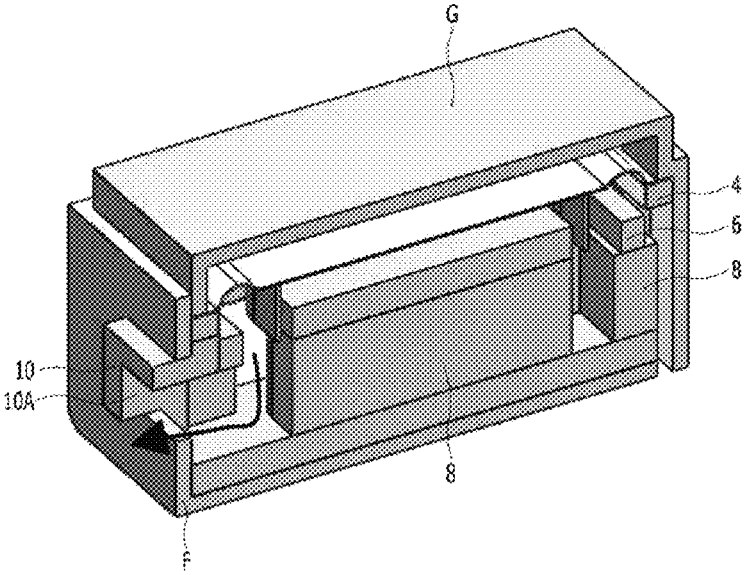
FIG. 14B is a sectional view of the microspeaker of FIG. 14A taken along the longitudinal centerline of the microspeaker.

FIGS. 14A and 14B show a P- and F-type rectangular microspeaker 1, i.e., a composite-type rectangular microspeaker 1, unlike in the above-described embodiments.

Magnets 8 are disposed at the center of a frame F and on the periphery of the frame F. A cutout portion 10A is provided in a middle portion to form a sound discharge opening O, thereby forming a space through which vibration sound can pass. The vibration sound generated on the bottom surface of a diaphragm 2 is discharged to the outside through a space provided by the cutout portion 10A.

Figure 14C:
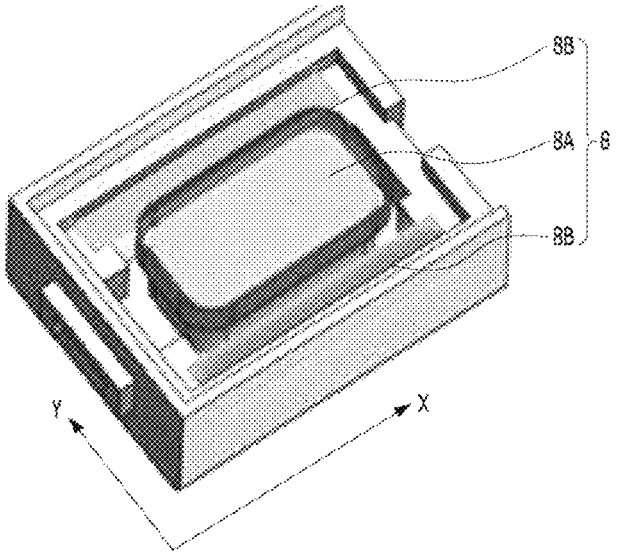
FIG. 14C is a perspective view of the microspeaker of FIG. 14A.

Referring to the plan view of FIG. 14C, there are arranged a total of three magnets 8, one central magnet 8A (of a P type) at the center and two side magnets 8B on both sides along a major axis X. Although the side magnets 8B may be an integrated annular magnet, they may be separated from each other as plate-shaped magnets as shown in the drawing.

As described above, according to the present invention, the magnets 8 may be arranged in various manners while using the basic principle of the present invention. For example, there may be possible various modifications, such as a case where two magnets are arranged along a major axis X or minor axis Y, a case where one magnet is placed at the center and two magnets are arranged along a minor axis Y, a case where magnets are arranged on all four sides along major and minor axes, and a case where one magnet is placed at the center and magnets are arranged on all four sides along major and minor axes.

<Embodiment which has a Hybrid Structure Using Insert Coupling>

Figure 15A:
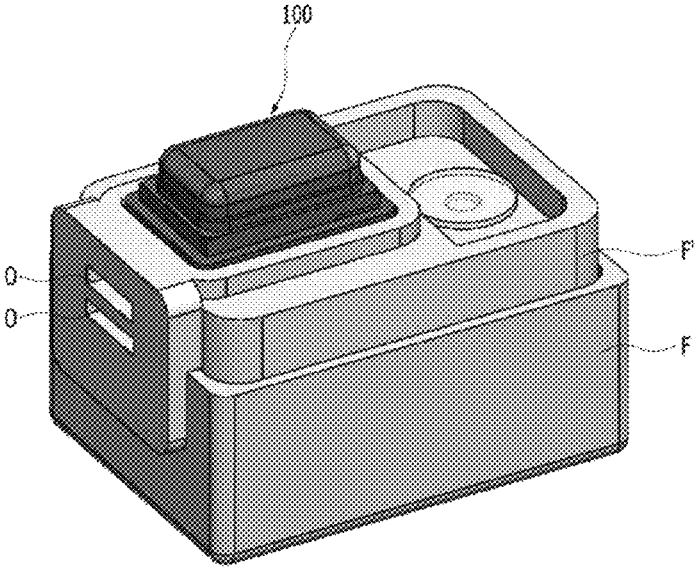
FIG. 15A is an external perspective view of a microspeaker according to another embodiment of the present invention.
Figure 15B:
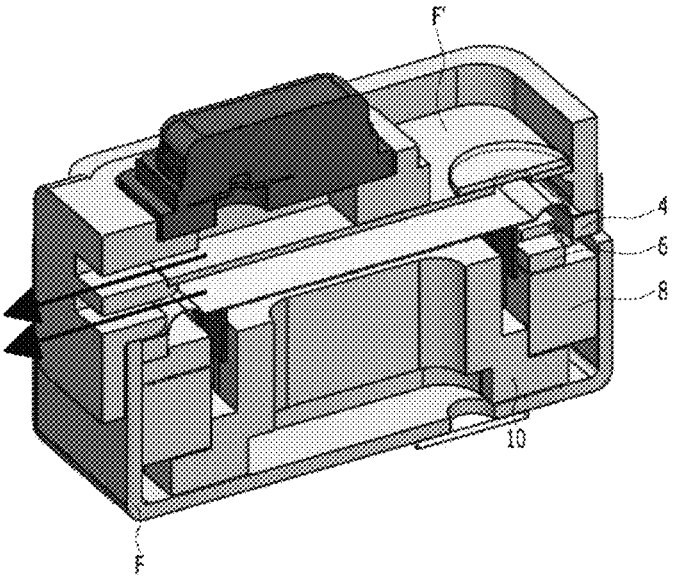
FIG. 15B is a sectional view of the microspeaker of FIG. 15A taken along the longitudinal centerline of the microspeaker.

FIGS. 15A and 15B disclose a hybrid-type microspeaker 1 in which the above-described basic structure of the microspeaker according to the present invention is installed in the lower portion thereof, a second microphone 100 is attached in the upper portion thereof, and two sound discharge openings O are formed in a side surface.

An upper frame F' which accommodates the second microphone 100 is designed to also function as a grille G. In other words, the grille G is a part of the configuration of the upper frame F'. Parallel passages are formed through the upper and lower portions of the grille G, and communicate with the sound discharge openings O, respectively. The advantage of the embodiment shown in FIG. 15 is that it is not necessary to fabricate the grille G separately due to the insert-molding of the upper frame F' which also functions as the grille G. Using this principle, in addition to the second microphone 100, various electronic parts, such as a PCB, may be easily coupled, assembled or bonded to the basic structure of the microspeaker 1 according to the present invention.

Figure 17:
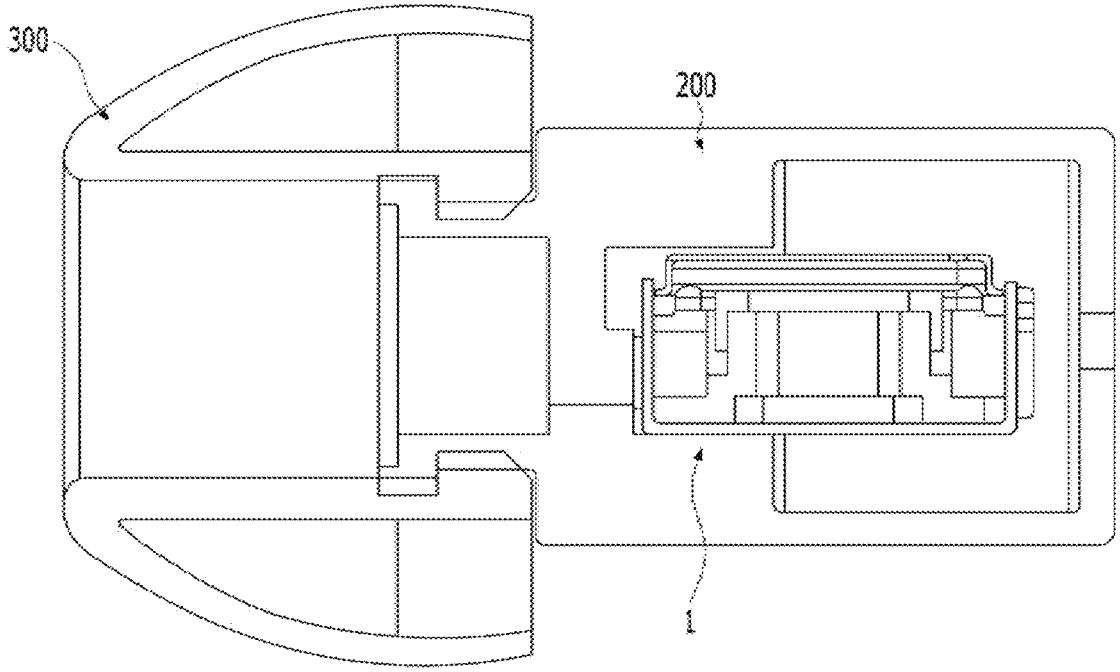
FIG. 17 is a view showing a state in which the microspeaker according the present invention is finally installed into an earphone which is an acoustic device.

FIG. 17 is a view showing a state in which the microspeaker 1 according to the present invention is finally installed into an earphone which is an acoustic device. The microspeaker 1 is accommodated in a housing 200, and an ear cap 300 is mounted on the entrance of the housing 200. The side where a sound discharge opening O is formed is inserted toward the ear canal of a user's ear.

In the present invention, a sound discharge opening O may be disposed in the front of the rectangular microspeaker 1 applied to an earphone. It is novel to apply such a structure to an earphone.

The present invention adopts the rectangular microspeaker, and provides the advantages of increasing an effective vibration area and expanding an internal space without the loss of magnetic flux density.

Although the present invention has been described in conjunction with the preferred embodiments, the present invention is not limited to the embodiments, but various modifications and alterations may be made to the present invention without departing from the spirit of the present invention by a person having ordinary skill in the art to which the present invention pertains.

What is claimed is:

1. A rectangular microspeaker comprising:

a plate configured to constitute a part of a magnetic field part, a magnet configured to be disposed beneath the plate, a diaphragm configured to be disposed on the plate, and a frame configured to accommodate the diaphragm, the plate, and the magnet;

wherein a path of vibration sound generated by the diaphragm is formed to be perpendicular to a direction in which the diaphragm vibrates so that the vibration sound is discharged through a side surface of the diaphragm or a path of vibration sound generated by the diaphragm is formed to be identical to a direction in which the diaphragm vibrates so that the vibration sound is discharged through a front surface of the diaphragm, wherein each of the diaphragm, the plate, and the magnet has a rectangular appearance, having long opposite rectilinear upper and lower sides in accordance with a shape of the frame, as a whole, and wherein additional spaces are secured in four corner portions of the frame in such a manner that outer portions of the plate are cut away at respective corners and respective corner portions of the magnet are chamfered or rounded, thereby increasing sound pressure in a frequency range of 1 to 5 kHz.

2. The rectangular microspeaker of claim 1, wherein a grille is disposed over the diaphragm, and a sound discharge opening configured to discharge vibration sound is formed in one side surface of the grille.

3. The rectangular microspeaker of claim 2, wherein a printed circuit board (PCB) is mounted on an opposite side surface of the grille or frame.

4. The rectangular microspeaker of claim 1, wherein a sound discharge opening configured to discharge vibration sound is formed in one side surface of the frame.

5. The rectangular microspeaker of claim 4, wherein the sound discharge opening is formed at a location below the diaphragm so that vibration sound generated on a bottom surface of the diaphragm is discharged through the side surface of the diaphragm.

6. The rectangular microspeaker of claim 1, wherein a printed circuit board (PCB) is mounted on an opposite side surface of the grille or frame.

7. The rectangular microspeaker of claim 6, wherein the magnet includes magnets which are arranged on at least both sides of the frame along a major or minor axis of the frame.

8. The rectangular microspeaker of claim 7, wherein the magnet further includes a magnet which is placed on a center portion of the frame.

9. An acoustic device comprising the microspeaker of claim 6.

10. The acoustic device of claim 9, further comprising a housing configured to accommodate the microspeaker.

11. The rectangular microspeaker of claim 1, wherein the rectangular microspeaker is of an F-type in which the yoke is disposed outside the magnet.

12. The rectangular microspeaker of claim 11, wherein the plate, the magnet, and the yoke are insert-molded.

13. The rectangular microspeaker of claim 12, wherein the plate, the magnet, and the yoke are insert-molded along with the frame.

14. The rectangular microspeaker of claim 1, wherein the rectangular microspeaker is of a P-type in which the yoke is disposed inside the magnet.

15. The rectangular microspeaker of claim 14, wherein the plate, the magnet, and the yoke are insert-molded.

16. The rectangular microspeaker of claim 15, wherein the plate, the magnet, and the yoke are insert-molded along with the frame.

* * * * *